US005564784A

United States Patent [19]

Felling

[11] Patent Number: 5,564,784

[45] **Date of Patent: * Oct. 15, 1996**

[54] KNOCK-DOWN SHELTERING AND ASTROLOGICAL OBSERVATION LOUNGE

[76] Inventor: Gerald J. Felling, 230 Arroyo Rd., Lagunitas, Calif. 94938

[ * ] Notice: The term of this patent shall not extend beyond the expiration date of Pat. No. 5,380,059.

[21] Appl. No.: 315,202

[22] Filed: Sep. 29, 1994

Related U.S. Application Data

[63] Continuation-in-part of Ser. No. 896,052, Jun. 9, 1992, Pat. No. 5,380,059.

[51] Int. Cl.[6] ..... A47C 4/00; A47C 1/00

[52] U.S. Cl. ..... 297/344.23; 297/184.15; 297/217.5; 5/656; 5/904; 135/96; 280/79.5; 180/22

[58] Field of Search ..... 297/217.1, 217.3, 297/344.21, 344.23, 184.1, 184.15, 184.14, 423.21, 423.19, 217.5; 5/656, 904; 135/96, 97, 103, 106, 107, 119; 180/22; 280/79.2

[56] References Cited

U.S. PATENT DOCUMENTS

| | | | |
|---|---|---|---|
| 2,669,784 | 2/1954 | Lewis | 297/217.1 |
| 3,908,666 | 9/1975 | Osborne . | |
| 4,379,588 | 4/1983 | Speice | 297/217.3 |
| 5,015,032 | 5/1991 | Felling . | |
| 5,069,504 | 12/1991 | Felling . | |
| 5,092,653 | 3/1992 | Felling . | |

FOREIGN PATENT DOCUMENTS

| | | | |
|---|---|---|---|
| 3443422 | 8/1986 | Germany . | |
| 137233 | 3/1930 | Switzerland | 297/217.1 |

*Primary Examiner*—Flemming Saether
*Attorney, Agent, or Firm*—Majestic, Parsons, Siebert & Hsue

[57] ABSTRACT

An adjustable lounge is adapted to be knocked-down in kit-form for shipping and/or storage purposes and expeditiously assembled on-site. The knocked-down-lounge comprises a base frame having a sub-frame and a pair of base side panels adapted for attachment to lateral sides of the sub-frame. A canopy frame comprises a pair of canopy side panels and a plurality of cross-struts adapted for attachment between the canopy side panels. The canopy frame is adapted to be pivotally mounted on the base frame to permit the canopy frame to be moved by user-controlled actuating means through an infinite number of positions between a normal upright position and a lowered position, placing the back of the canopy frame in at least general horizontal alignment with the top of the base frame. The lounge is adapted for selective rotation in a circular path about a vertically disposed axis whereby the frontal side of the canopy can be moved to a selected rotative position for sunning and/or viewing purposes. Additionally, the lounge may be used at nighttime as an astrological observatory.

20 Claims, 9 Drawing Sheets

KNOCK-DOWN SHELTERING AND ASTROLOGICAL OBSERVATION LOUNGE

CROSS-RELATED REFERENCE

This is a continuation-in-part of U.S. patent application Ser. No. 07/896,052, filed Jun. 9, 1992, issued as U.S. Pat. No. 5,380,059, on Jan. 10, 1995.

TECHNICAL FIELD

This invention relates generally to a recreational seating and lounging arrangement and more particularly to a pivotal sheltering lounge adapted to be knocked-down for shipping and storage purposes.

BACKGROUND OF THE INVENTION

My U.S. Pat. Nos. 5,015,032, 5,069,504 and 5,092,653 describe recreational lounges that have found widespread use, particularly at beaches and on the sun decks and patios of homes and hotels. Prior to the advent of my lounge, the backrests for conventional chaise lounges, popular in Europe, were normally fixed in position. Thus, the user was unable to adjust the backrest for comfort purposes. Although certain types of these lounges were later modified to permit the backrest to pivot and incline on a base, the externally operated locking mechanisms therefor proved difficult to manipulate and the substantial weight of the backrest (e.g., 75 lbs.) rendered the lounges impracticable for everyday use.

My above-referenced patents disclose lounges that overcome the above, briefly discussed problems of the prior art. In particular, each lounge comprises an adjustable canopy pivotally mounted on a frame to adjust the inclination of the canopy between an upright position and a lowered position, and operator-control means for selectively pivoting the canopy. The lounges have exhibited excellent performance, but have proven somewhat bulky for storage and/or shipping purposes. Further, I have discovered that it is desirable to provide the lounge chairs with the capability of being easily rotated for selective sunning and/or viewing purposes. The lounge of this invention solves these latter problems.

SUMMARY OF THE INVENTION

An object of this invention is to provide an adjustable lounge of the general type disclosed in my above-referenced patents, but which can be knocked-down in kit-form for shipping and/or storage purposes and expeditiously assembled on-site.

A further object is to provide the lounge with the capability of being rotated to a selected position, either manually or automatically, by the user.

U.S. patent application Ser. No. 07/896,052 (herein referred to as the parent application) describes a knocked-down lounge which comprises a base frame having a sub-frame and a pair of base side panels adapted for attachment to lateral sides of the sub-frame. The lounge further comprises a pair of canopy side panels and a plurality of cross-struts adapted for attachment between the canopy side panels to form a canopy frame. The canopy frame is adapted to be pivotally mounted on the base frame to permit the canopy frame to be moved by user-controlled actuating means through an infinite number of positions between a normal upright position and a lowered position, placing the back of the canopy frame in at least general horizontal alignment with the top of the base frame.

In the present application, additional improvements and/or modifications have been incorporated into the knocked-down lounge of the present invention. For example, the base sub-frame has been modified so that it too can be expeditiously assembled and disassembled on-site without comprising the structural integrity of the sub-frame in its assembled form. The ability of the sub-frame to be knocked down provides added utility to the present invention in that it enables the lounge of the present invention to be packaged in containers which can be conveniently handled and transported by a single person without requiring the use of additional persons to help carry the containers or the use of heavy machinery such as a forklift or crane. Additionally, the ability of the sub-frame to be knocked down also allows the lounge of the present invention to be shipped using a common carrier, such as UPS or DHL, thereby greatly facilitating the shipping process as well as reducing the cost associated with shipping the inventive lounge to a remote customer location.

In addition to the improvement described above, the lounge of the present invention has been modified to incorporate additional improvements such as, for example, redesigning certain features of the lounge to be child-resistant in order to prevent injuries; improving the lateral stability of the lounge; and increasing the weather-resistant features of the chair in order to prevent warping of the wood parts and rusting of the metal parts of the lounge.

In another aspect of this invention, pivot means, mounted beneath the base frame and positioned at least approximately centrally thereof, adapts the lounge for selected rotation in a circular path about a vertically disposed axis whereby the open frontal side of the canopy can be moved to a selected rotative position for sunning and/or viewing purposes. This feature can also be used in conjunction with astrological positioning features of the lounge to enable the lounge to be used at night as an astrological observatory.

BRIEF DESCRIPTION OF THE DRAWINGS

Other objects and advantages of this invention will become apparent from the following description and accompany drawings wherein.

DESCRIPTION OF THE PREFERRED EMBODIMENTS

Figure 1:
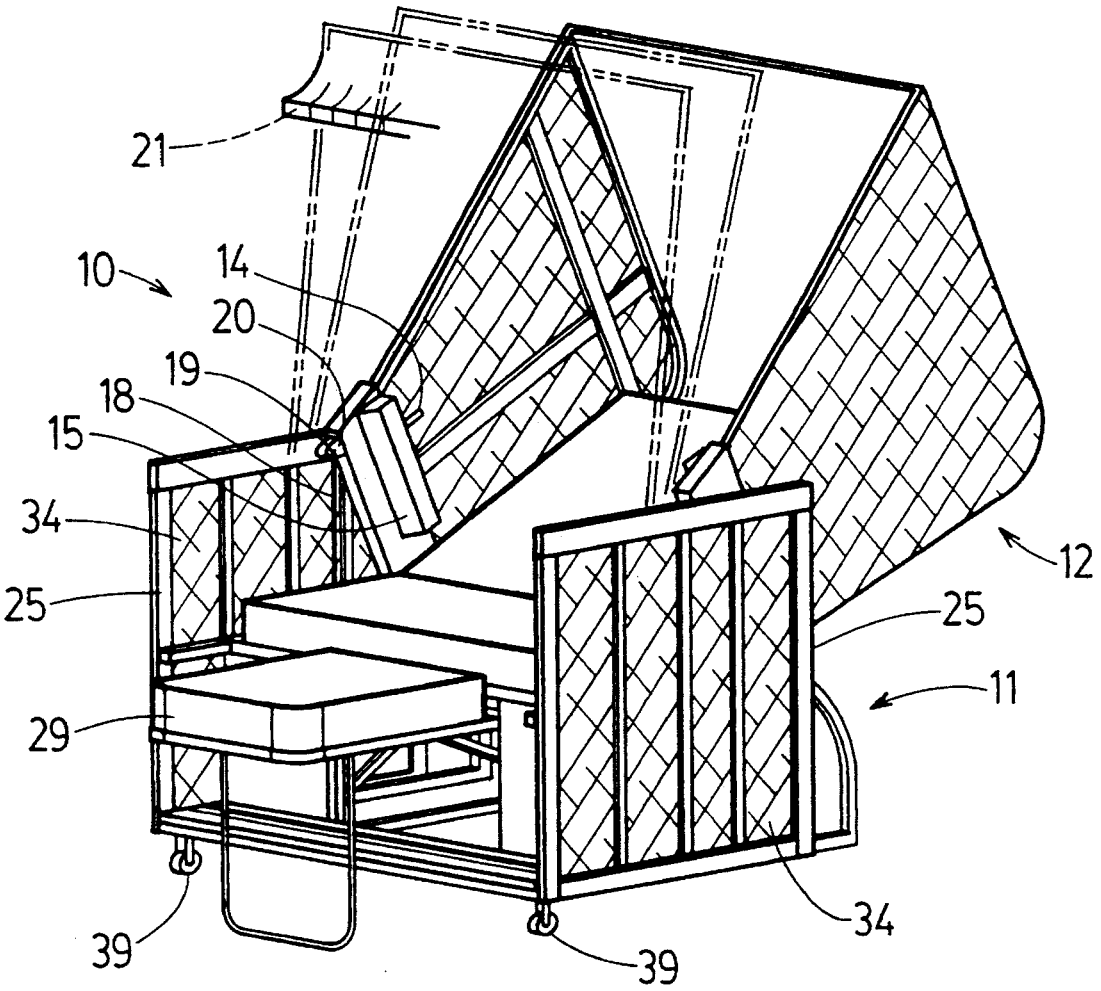
FIG. 1 is a frontal perspective view schematically illustrating a lounge embodying this invention with a canopy thereof shown in a lowered position in phantom lines.
Figure 2:
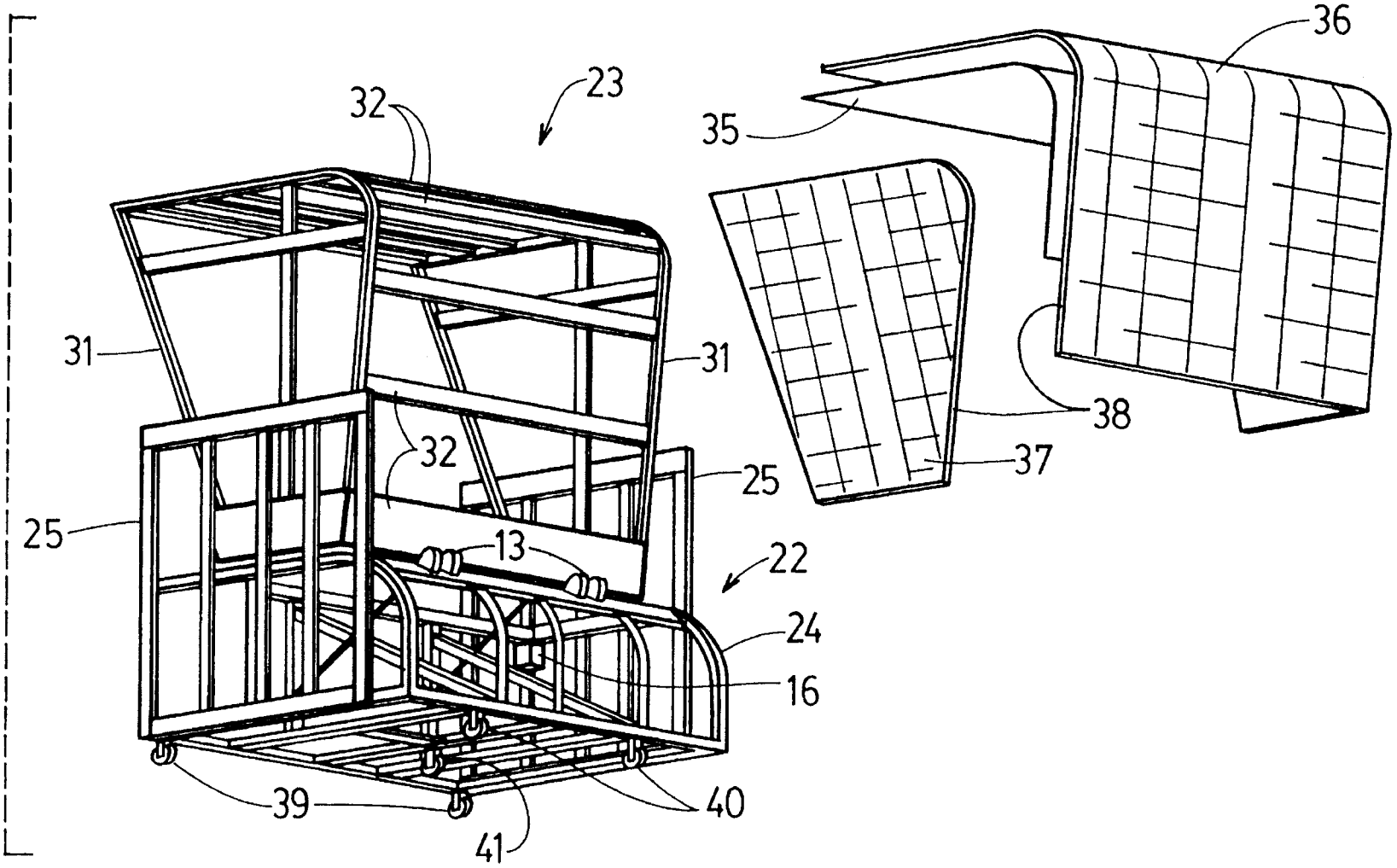
FIG. 2 is an exploded perspective view illustrating the mounting of a canopy frame on a base frame and cover panels adapted to be attached to the canopy frame.
Figure 3:
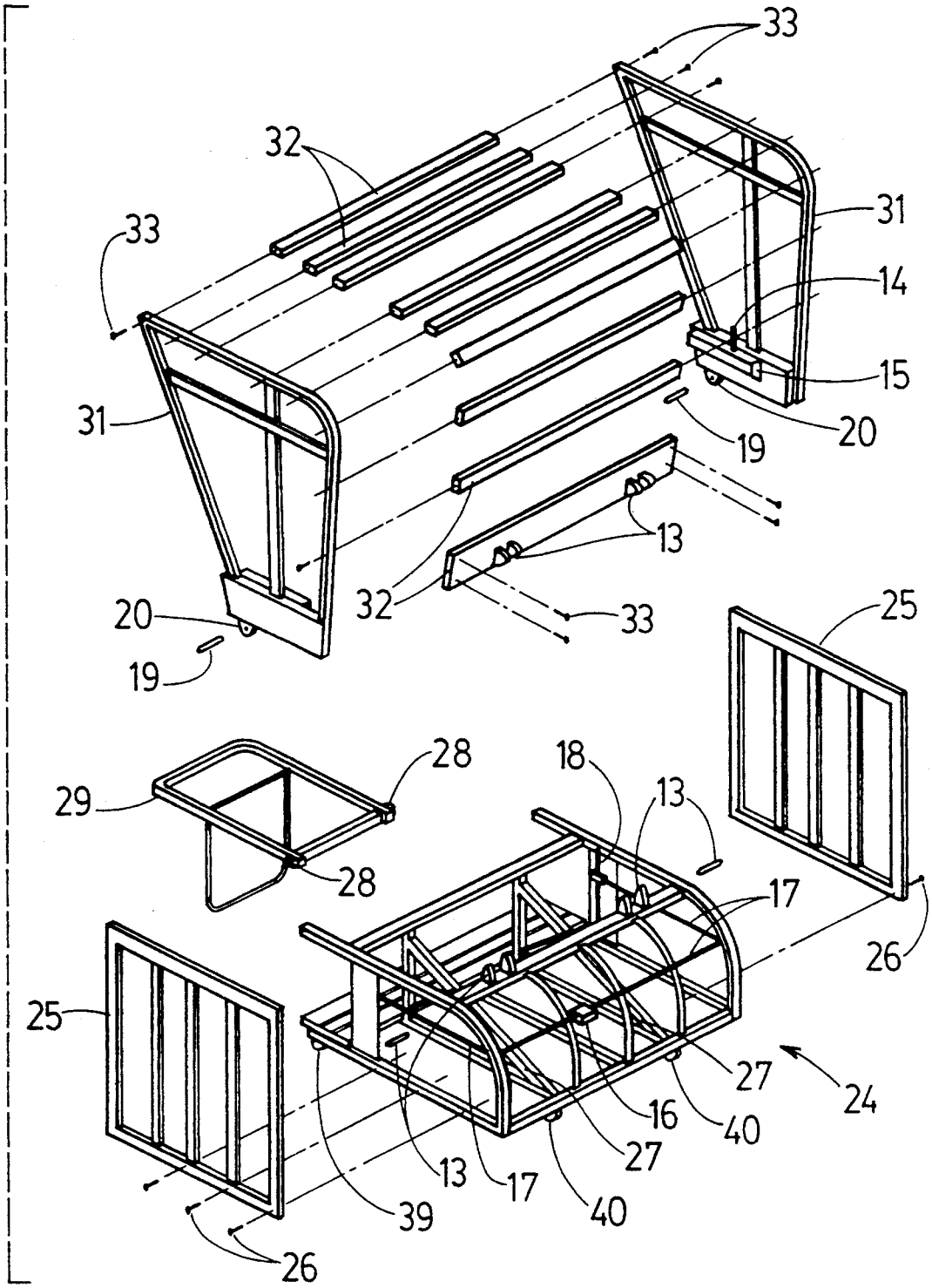
FIG. 3 is an exploded view of the canopy and base frames, illustrating component parts thereof that can be packaged in kit-form for shipping and/or storage purposes.

FIG. 1 illustrates a lounge 10 comprising a base 11 having a canopy 12 pivotally mounted rearwardly thereon by laterally spaced and aligned bracket and pivot assemblies 13 (FIGS. 2 and 3). The canopy is adapted to be selectively pivoted, under control of the user, from a normal upright position forming a seating arrangement to its illustrated lowered position, forming a bed-like or "sunning" arrangement. As fully described in applicant's above-referenced U.S. Pat. Nos. 5,015,032, 5,069,504 and 5,092,653, the disclosure of each of which is incorporated by reference herein, a three-way (up, down and neutral positions) switch 14 is mounted on an armrest 15, secured within canopy 12, to permit the user to selectively move the canopy to a chosen pivoted position on base 11.

As schematically illustrated in FIGS. 1–3, the switch is adapted to activate a combined moving, holding and locking control system mounted in base 11. In one embodiment, the control system comprises an electric battery-driven (e.g., eight volt battery) reversible motor 16 secured on the base, drive cables 17 and a pair of threaded drive rods 18 (one shown in FIG. 3) suitably mounted on opposite sides of base 11. As described in U.S. Pat. No. 5,069,504, the upper end of each drive rod is adapted to be pivotally connected by a pin 19 to a bracket 20 (FIG. 3), secured to canopy 12. Thus, selective extension or retraction of the drive rod will function to pivot the canopy about the co-incident axes of pivot assemblies 13 on the base. In another embodiment, the moving, holding, and locking control system operates hydraulically, similar to that of an airplane seat-back. Since applicant's referenced patents fully describe the combined moving, holding and locking control system in detail, further explanation thereon is deemed unnecessary for a full understanding of this invention. The patents also describe the optional use of a retractable sun shade 21, mounted on canopy 12 as schematically shown in FIG. 1.

Referring to FIG. 3, one aspect of the present invention is the ability to fabricate and knock-down lounge 10 which can be packaged in kit-form for subsequent assembly on-site. As shown in FIGS. 2 and 3, base 11 comprises a base frame 22 whereas canopy 12 comprises a canopy frame 23 adapted to be assembled and pivotally mounted on the base frame by laterally spaced bracket and pivot pin assemblies 13. As shown in FIG. 3, the base frame comprises a base sub-frame 24 having lateral sides and a horizontally disposed top adapted to retain a seating cushion thereon (FIG. 1).

Base frame 22 further comprises a pair of base side panels 25 each adapted for attachment to a respective lateral side of the base sub-frame by fastening means such as screw 26. The base frame has a pair of inclined and laterally spaced slotted rails 27 secured therein to receive rollers 28, secured on the end of a footrest frame 29, whereby the footrest frame is adapted to slide into the base frame for storage purposes therein. As further shown in FIGS. 2 and 3, canopy frame 23 comprises a pair of canopy side panel frames 31 and a plurality of cross-struts 32, adapted to have opposite ends thereof suitably attached to the canopy side panel frames by fastening means, such as screw 33, to form the canopy frame.

For shipping purposes, the component parts of the lounge, illustrated in FIG. 3, can be compactly packaged to reduce the volume of the lounge to approximately not more than one-fifth of its erected size as shown in FIG. 1. When the knocked-down lounge arrives at its destination, the component parts cain then be unpackaged for expeditious assembly.

In the parent application, it was disclosed that the component parts of the lounge could be compactly packaged in and about the base sub-frame 24 to reduce the overall volume of the lounge to approximately one-fourth of its erected size. It is to be noted that the base sub-frame 24 in the parent application was not broken down into its component parts, but rather remained in its assembled form when shipped. This is because the base sub-frame 24 in the parent application was preferably assembled using welding joints to join together the various parts of the base sub-frame in order to ensure the structural integrity of the base sub-frame. That is to say, by welding the various parts of the base sub-frame 24 together, the sub-frame 24 would have sufficient structural integrity to withstand the load and torsional forces exerted upon it caused by the weight of the canopy frame and the leveraged forces exerted upon the sub-frame when the canopy is in its horizontal position. Additionally, the sub-frame must be able to withstand additional forces associated with persons reclining in the bed of the canopy.

Thus, in order to accommodate the load and torsional forces which would be applied to the sub-frame 24, it was conventional practice to weld the pieces of the sub-frame together rather than using connectors, such as nuts and bolts. This is because no connectors were known which could withstand the above-described load and torsional forces over a long period of time without fatiguing or failing. Moreover, experimental evidence suggested that joining the sub-frame together by connectors, rather than by welding joints, compromised the structural integrity of the sub-frame, eventually causing the sub-frame to fatigue and/or fail over an extended period of time.

Based on such evidence, it appeared impractical that a sub-frame could be assembled in kit-form using connectors. However, contrary to accepted theory and practice, based on experimentation conducted by the present inventor, it has been shown, that unexpectedly, connectors can be utilized for connecting the assembled parts of the sub-frame together without compromising the structural integrity of the sub-frame.

Figure 8:
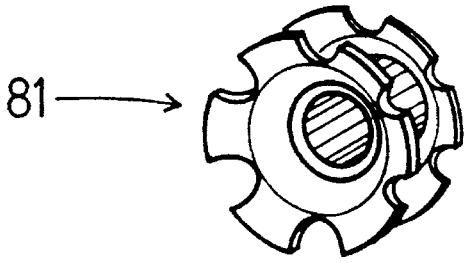
FIG. 8 is a perspective view of a connector which is used for connecting the various parts of the base sub-frame together.
Figure 9:
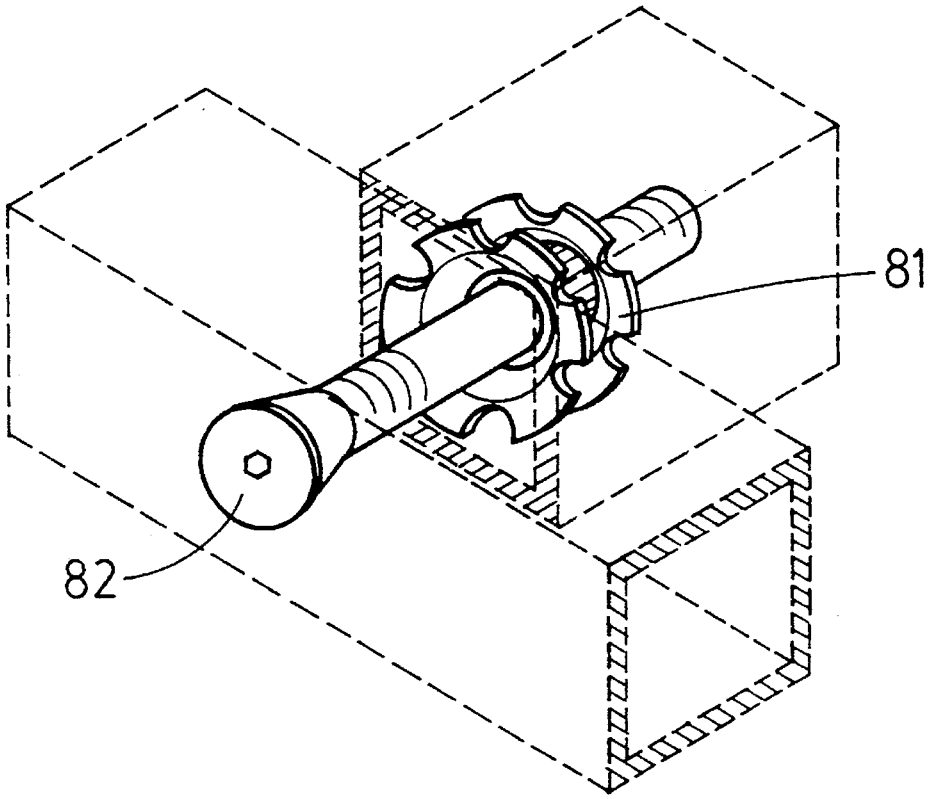
FIG. 9 schematically illustrates one embodiment of how the connector of FIG. 8 is used to connect the various component parts of the base sub-frame together.

FIG. 8 shows a perspective view of one embodiment of the connector 81 used for joining the various component parts of the sub-frame 24 together. The connector is preferably made of a high carbon steel, or other material which has similar strength and which has sufficient resiliency to allow the flanges of the connector to flex slightly when being inserted into the tubing. The connector is preferably threaded for use in conjunction with a screw or bolt 82, as shown in FIG. 9. Although other embodiments of the connector shown in FIG. 8 are contemplated, it is preferable that the connector be inexpensive, self-centering, and easily installable.

FIG. 9 shows the connector 81 used in conjunction with a screw or bolt 82 for fastening together two pieces of tubing (shown in phantom in FIG. 9). The tubing may be either rectangular, circular or triangular in cross-section. Both the connector 81 and the bolt 82 should preferably be made from materials which are strong enough to prevent the threads of both from stripping when the two are securely fastened together as shown in FIG. 9. In addition, both the connector 81 and the bolt 82 are preferably coated with a protectant such as, for example, zinc, to protect the metal against corrosion caused by exposure to salt water and moisture.

Because the sub-frame 24 can now be easily assembled and disassembled on-site without compromising the structural integrity of the sub-frame, this allows the lounge of the present invention to be packaged into containers for shipping which can be conveniently handled and transported by a single person without requiring the use of additional persons to help carry the containers or the use of machinery such as a forklift or crane. In addition, the ability of the sub-frame 24 to be knocked-down also allows the lounge of the present invention to be shipped using a common carrier, such as UPS or DHL, thereby greatly facilitating the shipping process as well as reducing the cost associated with shipping the inventive lounge to a remote customer location.

For shipping purposes, the lounge of the parent application was packaged into a single large container and transported on a wooden palette. The total dimensions of the container and palette were approximately 48"×54"×40". Because of it size, the container could not easily be handled by a single person, and additionally could not be shipped via a common carrier since the container exceeded the maximum dimensions specified by most common carriers. For example, UPS requires that all containers be less than 130 inches total in length and girth. DHL requires that no side of the container be larger than 48 inches. Because of these restrictions, the chaise lounge of the parent application could not be shipped using such common carriers.

However, the various parts of the chaise lounge of the present invention may be packaged into two containers, wherein one container has the dimensions of approximately 8.5"×18.5"×48", and the other container has dimensions of approximately 6"×"36"×41". Additionally, a third container which contains all of the cushions for the lounge of the present invention may also be included with the shipment. The dimensions of this third container are approximately 21"×22"×44". The relative size of each of these three containers allows each container to be shipped using a common carrier. Thus, by using a common carrier to ship the knocked-down lounge of the present invention, shipping costs are able to be reduced by as much as two-thirds of the cost of shipping the single container and palette of the lounge of the parent application.

As shown in FIG. 1, base side panels 25 preferably have upholstery 34 secured thereon, prior to shipment. However, since the canopy 12 is also broken-down for shipping purposes, FIG. 2 illustrates upholstery that is applied to canopy frame 23 on-site. In particular, the upholstery may comprise a liner 35 that is first stapled or otherwise suitably secured on the top and back of the canopy frame. The liner is then covered with an upholstery main body 36 that covers the top, back and one side panel frame of the canopy frame. After main body 36 has been stapled or otherwise suitably secured to frame 23, a separate upholstery side panel 37 is releasably attached by a zipper 38 (or Velcro type hook and loop fastening means) to side edges of the top and back panels of the upholstery main body to cover the second canopy side panel frame.

The upholstery may comprise any suitable and preferably "breathable" material, such as a natural or synthetic woven fabric that is sufficiently porous to provide air ventilation through the canopy for convenience of the user. Applicant's above-referenced patents disclose alternative materials for the upholstery or covering used for the base and canopy. The component parts composing the base frame and canopy frame may be wood or structural plastic, steel or aluminum tubing or a combination thereof, as also described in the above-referenced patents.

As further shown in FIGS. 1–3, base frame 22 is suitably mounted on a pair of laterally spaced front casters 39, a pair laterally spaced rear casters 40 and a center pivot caster 41. The standard casters, when unlocked, facilitate movement of the lounge into various recreational pursuits. Each of the standard casters is an off-the-shelf item, such as the type marketed by The Tente Company under Model No. 2475 or 2470.

Figure 4:
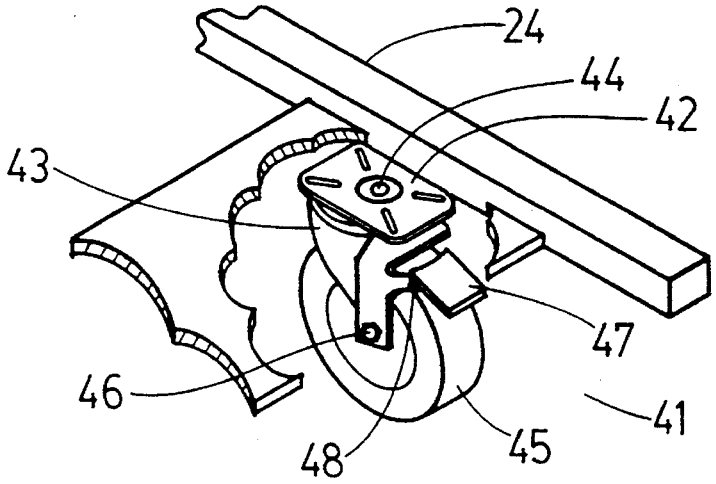
FIG. 4 illustrates a typical pivotal and lockable roller of a caster secured beneath the base frame to provide a center pivot for the lounge.

In particular and as shown in FIG. 4, a typical standard caster of this type comprises a steel mounting plate 42 secured to the underside of base sub-frame 24 and having a bifurcated swivel bracket 43 pivotally mounted thereon by a pivot shaft 34. A synthetic or natural rubber roller 45 is rotatably mounted on the bracket by an axle 46 and a brake lever 47 is pivotally mounted by a pin 48 on the bracket to have an end thereof selectively frictionally engage the roller to lock and prevent rotation thereof when the brake lever is depressed. Lifting of the brake lever will release the roller from its locked condition in a conventional manner. Since casters of this type are well-known in the art, further description thereof is deemed unnecessary for a full understanding of this invention.

Figure 5:
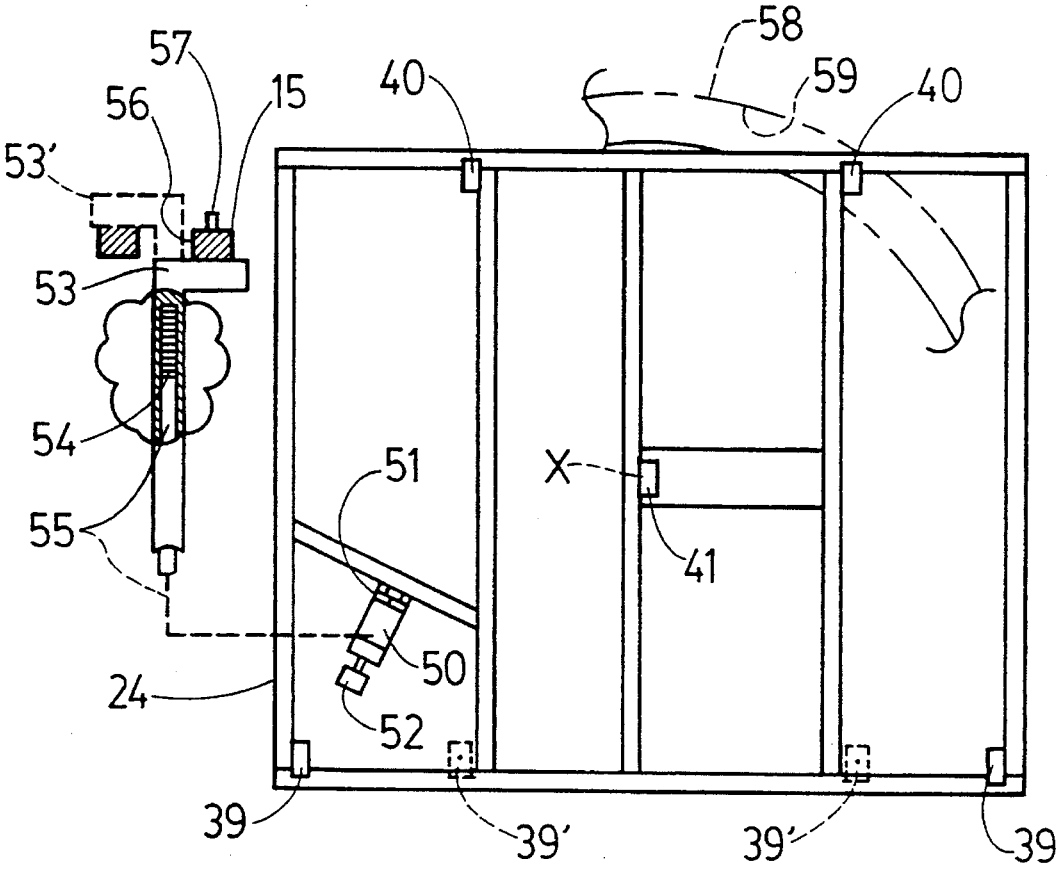
FIG. 5 is a schematic bottom plan view of the base frame, illustrating an operator-controlled drive motor for selectively rotating the lounge and further schematically illustrating a portion of a track in phantom lines, adapted to guide rotative movements of the lounge.

FIG. 5 schematically illustrates the disposition of casters 39–41 on the underside of base sub-frame 24. As shown, front and rear casters 39, 40 are concentrically arranged above a vertically disposed pivot axis X (pivot shaft 44 in FIG. 4) of center pivot caster 41. Thus, release of brake levers 46 of only the front and rear casters, with the center pivot caster remaining in its locked or brake-mode of operation, will permit the entire lounge to be rotated about centrally and vertically disposed axis X of pivot shaft 44. In an alternate embodiment (not shown), the center pivot caster 41 may be omitted, leaving only four casters for rotating the lounge.

Once the lounge has been rotated to its selected position by the user, brake lever 47 of one or more of the front and rear casters is depressed to lock base sub-frame 24 and thus the lounge in this selected rotative position. This arrangement thus provides pivot means mounted beneath base 11 for selectively permitting the lounge to be rotated in a circular path about vertically disposed axis X (pivot shaft 44 of center pivot caster 41) whereby the open frontal side of canopy 12 can be moved to a selected rotative position for sunning and/or viewing purposes. Release of the brake levers of all of the casters, including caster 41, will permit the lounge to be rolled to another location.

FIG. 5 further illustrates operator-control means for selectively rotating the lounge. An electric drive motor 50 is pivotally mounted on base sub-frame 24 at a hinge connection 51 for vertical movement. The motor is adapted for pivotal movement between a raised and a lowered position whereat a rubber drive wheel 52 will frictionally engage a cement patio or the like for lounge-rotating purposes. In particular and as shown in FIG. 5, when a handle 53 is in its illustrated depressed position to engage drive wheel 52 whereby activation of the reversible electric drive motor 50 will function to rotate the lounge about vertically disposed pivot axis X of center pivot caster 41. The weight of the motor is sufficient to hold wheel 52 in driving, frictional engagement with the patio.

As further schematically shown in FIG. 5, when handle 53 is retained in its engaged position beneath armrest 15, an optional compression coil spring 54 secured between the handle and a cable 55 will permit the motor to drop. When the handle is turned 90° and returned to its raised, phantom-line position 53' through an accommodating slot 56 formed through armrest 15, cable 55, having its distal end secured to motor 50, will be placed in tension to pivot the motor upwardly about hinge connection 51 to raise drive wheel 52 above ground level. A standard three-position switch 57, suitably connected in a conventional manner between the motor and an electrical six or eight volt battery (not shown) mounted in base sub-frame 24, is secured on armrest 15 for convenience of the user sitting in the lounge.

FIG. 5 further illustrates an alternative lounge-mounting system shown in the form of a foot pad assembly, particularly useful when the lounge is disposed on grass, sand or other soft surface. In particular, the lounge may be rotatably mounted on a schematically and partially illustrated steel ring 58 that has an upwardly facing U-shaped cross-section to define a circular track 59, concentrically disposed relative to vertically disposed pivot axis X of center pivot caster 41. When a circular track of this type is utilized, front casters 39 are preferably repositioned to the illustrated phantom-line positions 39' to be disposed at the same radius from pivot axis X as are rear casters 40, one of which is shown disposed in circular track 59.

It can thus be seen that locking of center pivot caster 41 to fix the position of axis X will permit front casters 39' and rear casters 40 to swivel in the same circumferential path and rotate with the lounge in circular track 59 whereby the lounge can be rotated to a selective sunning position. Such rotative adjustment can be made either manually or under control of drive wheel 52. The drive wheel can also be radially disposed on the same radius as the casters to engage within circular track 59, if so desired.

Figure 10:
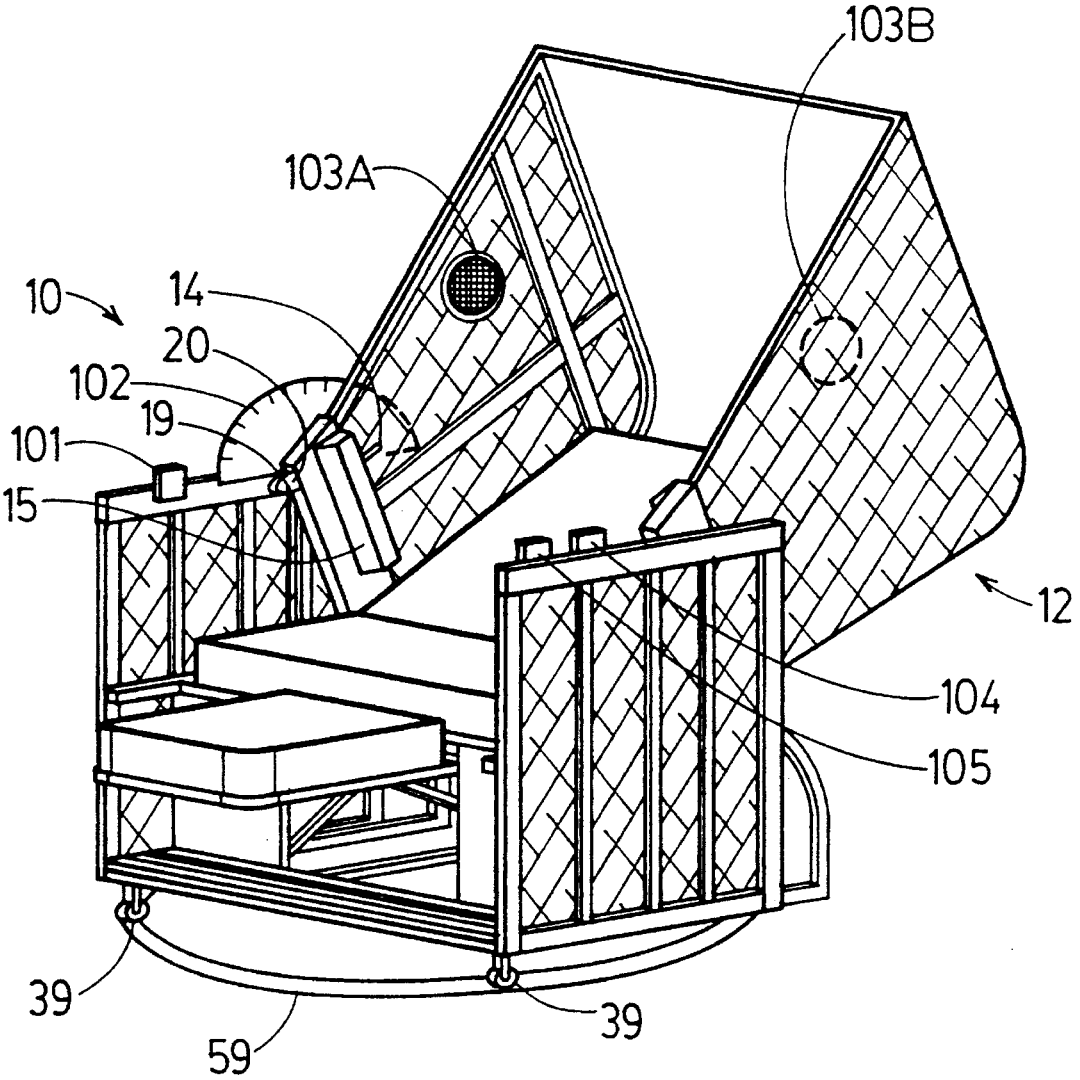
FIG. 10 shows a perspective view of the lounge of the present invention wherein the lounge includes additional features which permit it to be used as an astrological observatory.
Figure 11:
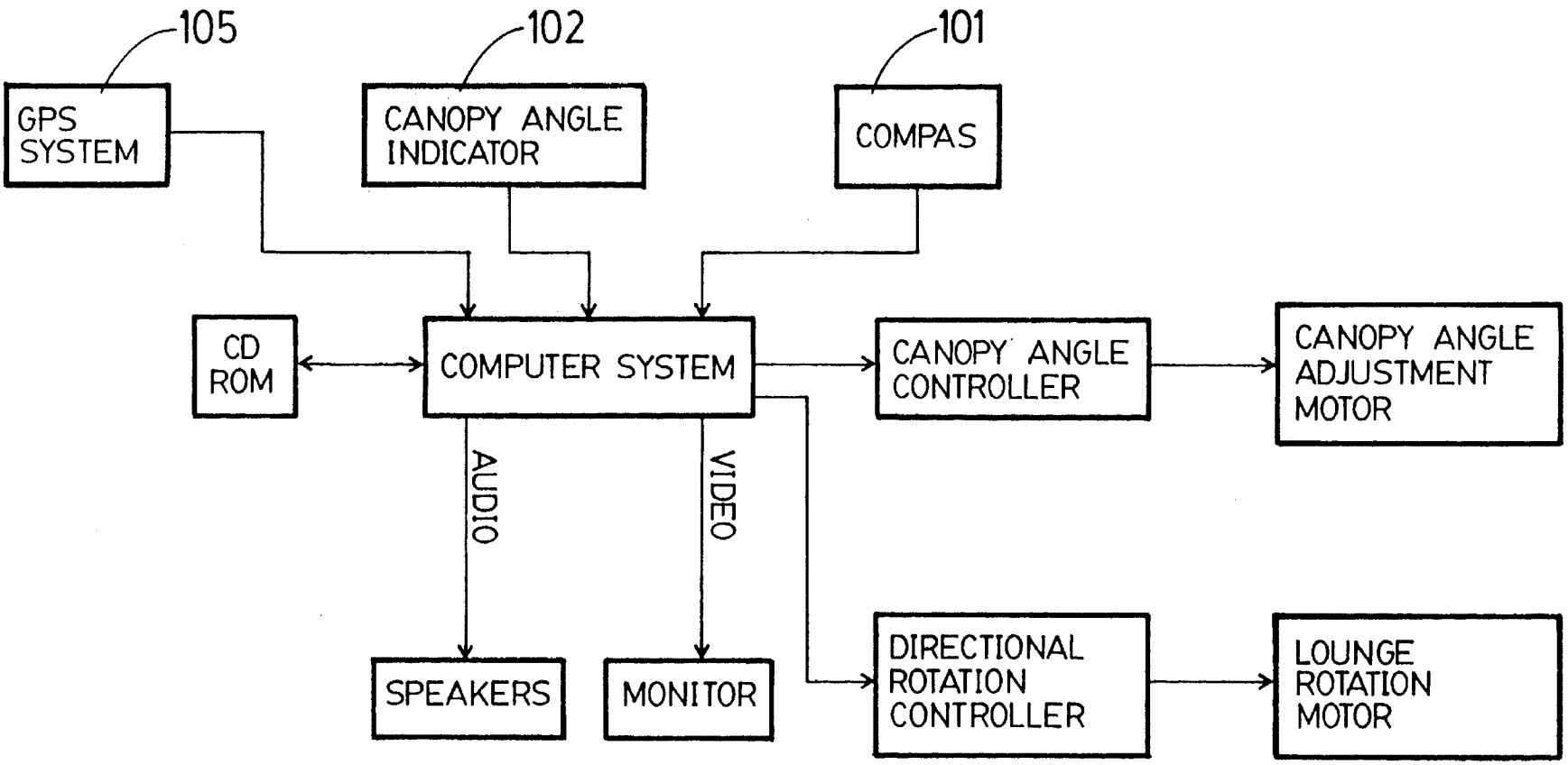
FIG. 11 shows a block diagram of the circuitry used to implement the astrological observatory features of the present invention.

In an alternate embodiment, as shown in FIGS. 10 and 11, the rotatable feature of the lounge as well as the adjustable feature of the canopy may be used in conjunction with other standard equipment to enable the lounge of the present invention to be used as an astrological observatory for permitting the user to view the constellations of the nighttime sky. As commonly known to those skilled in the art, precise identification of the constellations may be identified from a reference point on Earth using an ordinary constellation chart. In order to use the chart, approximate latitude, direction, time and date must be known.

The astrological observatory feature of the present invention may be designed according to one of several embodiments. One embodiment is shown in FIG. 10, which shows a perspective view of the lounge of the present invention including additional features which permit it to be used as an astrological observatory. As described previously, the lounge of the present invention already includes several mechanisms for positioning the canopy into an infinite number of positions, and for rotating the lounge 360 degrees about a central axis. By adding a compass 101 for determining rotational direction and an angle indicator 102 for determining the angular position of the canopy relative to the horizontal, a user is able to consult a constellation chart, and then recline in the bed of the canopy and position the direction of the chair and the angle of the canopy to view the desired portion of the nighttime sky with some accuracy to determine which constellations are within view. A bubble level 104 may optionally be provided to ensure that the lounge is level relative to the horizontal. Additionally, a telescope (not shown) may be attached with the lounge to afford the user a more detailed view of the constellations.

Thus, after consulting the constellation chart and determining which portion of the nighttime sky the user wishes to view, the user may recline in the lounge, and position the direction of the chair using the compass 101 and the angle indicator 102 of the canopy to permit the user to view the desired portion of the nighttime sky when reclining in the bed of the canopy. As the user is reclining in the bed of the canopy, the canopy side walls and top limit the user's field of view to allow the user to determine with some accuracy the particular constellations which are within his or her view.

According to one embodiment, the user's is able to select the particular view of the nighttime sky which he or she desires by positioning the lounge accordingly.

According to an alternate embodiment, electronic sensors (not shown) may be added to the compass 101 and angle indicator 102, with the information from the sensors fed into a computer system equipped with a software package that can read the compass location and the inclination of the canopy to determine the location of the sky that is within the user's view. An example of such a system is shown in FIG. 11. The latitude, time and date information may be provided to the computer by the user, or may be obtained from commonly available systems such as a real-time clock calendar for the time and date, and a global positioning system detector 105 for determining approximate latitude. The computer system will also come equipped with memory such as, for example, CD ROM, which contains maps of the constellations at various latitudes, and which also may contain audio and/or video information regarding each of the constellations. Given this information, the software package is able to determine the particular constellations which are within the view of the user, and is then able to access the audio/video information from the CD ROM to provide the user with a verbal and/or pictorial description of the constellations which user is currently viewing in the sky. For such a feature, the lounge may be equipped with a small video monitor (not shown) and/or speakers 103A, 103B for permitting the video/audio information to be broadcast to the user.

Additionally, the computer system may be located within the lounge or, alternatively, may be located at a remote location and linked with the electronic circuitry of the lounge via a radio transmitter, such as those common in many of today's police vehicles. Additional controls within the lounge, accessible to the user, would permit the user to control the audio and video information being displayed. Such controls may include, for example, an on/off switch, a program selection switch, and a volume control.

In an alternate embodiment, the astrological observatory feature of the lounge could be made to be interactive such that the user requests to see a desired constellation, and inputs this request to a computer system. The computer system then calculates the necessary positioning of the chair, and automatically adjusts the direction and angular position of the canopy to enable the user to view the desired constellation. Commonly available remote control electronic relays may be provided to the various motors within the chair to permit the computer system to control the rotation of the chair as well as the inclination of the canopy. The interaction between the user and the computer system may be accomplished, for example, by the use of a keyboard, mouse or, alternatively, may be voice-actuated. Additionally, if the user desires, he or she may simply request to go on a tour through the constellations, at which point the computer system will control all aspects of the user's view of the nighttime sky, narrating information about the constellations as the computer system rotates the lounge to different positions.

Alternatively, once the user has positioned the direction of the chair and the inclination of the canopy to the desired angle, the user may play a pre-recorded description of the particular part of the sky which he or she is viewing by plugging in a pre-recorded tape or CD into a portable tape deck or a CD player, or into the sound system of the lounge, when provided.

Figure 6:
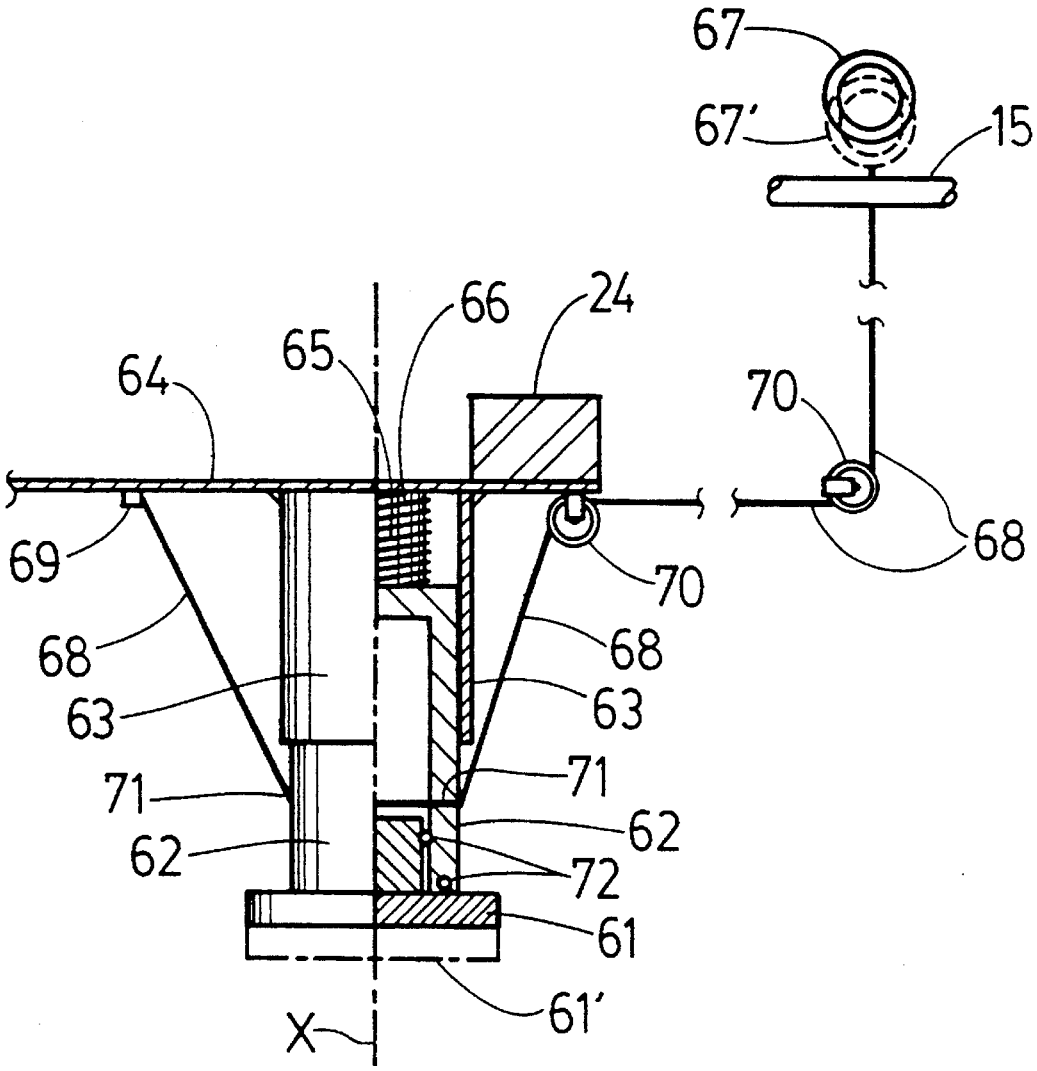
FIG. 6 schematically illustrates an alternative center pivot and an operator-controlled actuating mechanism therefor.
Figure 7:
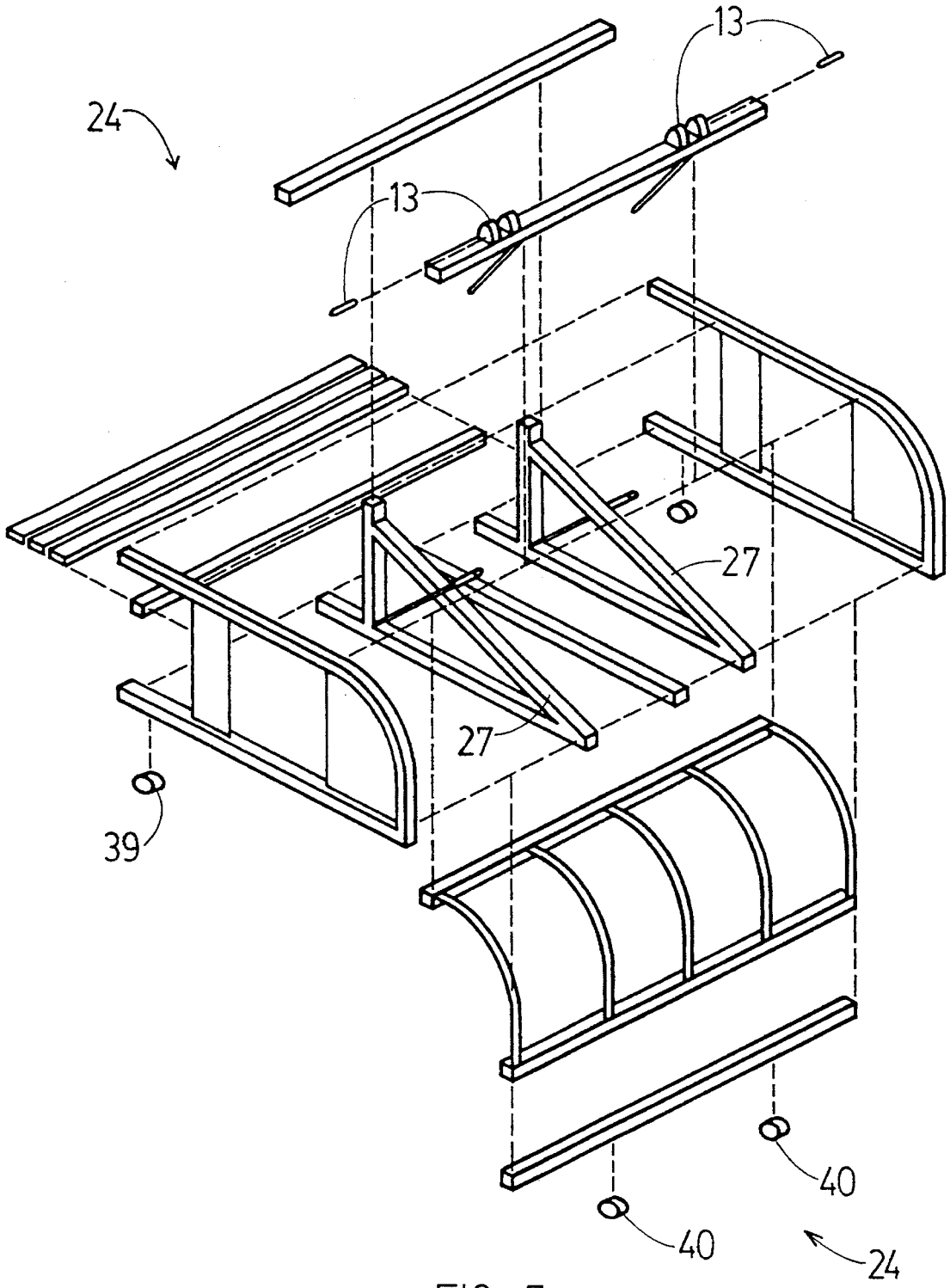
FIG. 7 is an exploded view of the base subframe, illustrating component parts thereof that can be packaged in kit-form for shipping and/or storage purposes.

FIG. 6 disclosed an alternate center pivot arrangement that would normally replace center pivot caster 41 (FIG. 5). This alternate pivot means comprises a reciprocally mounted elastomeric foot pad 61 adapted to engage ground level, such as a patio surface, to permit the lounge to be selectively rotated on front and rear casters 39, 40 and about a vertically disposed pivot axis X, positioned centrally of the lounge. The foot pad can be suitably rotatably mounted on a distal end of a tubular pad support 62, reciprocally mounted in a guide tube 63. The guide tube has its upper end secured beneath a plate 64 and the plate, in turn, is secured beneath base sub-frame 24 of the lounge.

A compression coil spring 65 is disposed between plate 64 and the upper end of tubular pad support 62 and mounted on a post 66, having its upper end secured beneath plate 64. The spring functions to bias the tubular pad support downwardly to its 61' engaged position. Control means for controlling the raising and lowering of elastomeric foot pad 61 may comprise a finger ring 67 having one end secured to a cable 68 and its opposite end anchored to plate 64 at an anchoring block 69.

Cable 68 is entrained over rollers 70 and extends through openings 71, formed diametrically through tubular pad support 62, whereby reciprocation of finger ring 67 will selectively raise or permit lowering of elastomeric foot pad 61. In particular, when the finger ring is raised to its solid line position illustrated in FIG. 6, cable 68 will function to raise elastomeric foot pad 61 above ground level and against the opposed biasing force of compression coil spring 65 to permit the lounge to be moved.

Conversely, release of finger ring 67 will permit it to move to its 67' phantom line position and release cable 68. Spring 65 will bias foot pad 61 into frictional engagement with a patio or other surface on which the lounge is situated. Standard annular bearings 72 can be suitably mounted between the foot pad and tubular pad support 62 to permit the support and thus the lounge to freely rotate about axis X and relative to the foot pad. The lounge can be locked against rotation by depressing brake lever 47 (FIG. 4) of one or more casters 39 and 40.

A further modification to the above-described pivot means contemplates replacing the foot pad assembly shown in FIG. 6 with a single steel rod. The rod could be inserted vertically through a bore (not shown) formed through plate 64 (or frame 24) to have its lower end further engage within a bore drilled in a patio or the like, the lounge could then be selectively rotated about the vertical pivot axis of the rod. It should be noted in FIGS. 1 and 3 that single footrest frame 29 is positioned to provide easy access to the seat by a user and facilitates storage of the foot cushion below rails 27 for storage purposes and to eliminate clutter.

The lounge of the present invention has also been modified to incorporate additional improvements with respect to the lounge of the parent application. For example, certain features of the lounge of the present invention have been redesigned to be child-resistant in order to prevent injuries. Additionally, the overall structural integrity of the lounge has been strengthened. For example, a solid aluminum support bracket (not shown) has been added to the top of the canopy to improve its lateral stability. Improvements have also been made to the lounge of the present invention to increase its ability to endure exposure to unfavorable climate conditions (i.e. to increase its weather-resistance) in order to prevent warping of the wood parts and rusting of the metal parts of the lounge. For example, plastic surfaces have been attacked to various wooden parts of the lounge to prevent the wood from warping over long-term exposure to moisture. Additionally, high carbon steel metal parts within the lounge such as the springs used to raise and lower the canopy bed, for example, have been replaced with stainless steel springs. The stainless steel springs have been specially designed to accommodate the load factors associated with the lounge of the present invention, and since they are made of stainless steel, they will not rust over long term exposure to salt water and/or moisture. It is to be understood that the replacement of the metal parts could be accomplished using other types of materials which have similar properties to that of stainless steel for retarding the formation of rust over long term exposure to salt water and/or moisture.

In addition to the improvements and embodiments described above, the lounge of the present invention can also be fabricated using an injection molded plastic process. That is to say, each of the component parts of the lounge of the present invention can be fabricated out of plastic, and designed so that the individually fabricated parts snap together to form a sturdy, structurally sound frame in accordance with the teachings in the present application. Such an injection molding process is available for forming the frame of the present inventive lounge primarily because the present invention can be knocked-down completely into individual component pieces. Without the ability of the lounge to be knocked-down into individual pieces, the injection molding process could not be used since the frame of the lounge would be too large to fabricate as a single structure using an injection molding process.

It is to be understood that while the invention has been described above in conjunction with preferred specific embodiments, the description and examples are intended to illustrate and not limit the scope of the invention, which is defined by the scope of the appended claims.

What is claimed is:

1. A knocked-down sheltering lounge in kit-form adapted to be assembled on-site for sunbathing comprising:

a base frame comprising a sub-frame having lateral sides and a horizontally disposed top adapted to retain a seating cushion thereon, said top comprising a plurality of longitudinally spaced and laterally extending cross-struts adapted to be connected and disconnected between the lateral sides of said sub-frame for mounting said seating cushion thereon, and a pair of base side panels adapted to extend vertically above the lateral sides of sub-frame to form arm rests and to confine said seating cushion in said sub-frame, a pair of substantially flat canopy side panel frames and a plurality of individual cross-struts adapted to be spaced one-from-another and have opposite ends thereof attached to said canopy side panel frames to form a canopy frame, open at a frontal side thereof and adapted to be pivotally and removably mounted onto said base frame for permitting said canopy frame to be moved through an infinite number of locking positions between a normal upright position to form a seating arrangement and a fully lowered position placing the back of said canopy frame in at least general horizontal alignment with the top of said base frame to form a bed, one of said cross-struts having pivot means thereon for pivoting said canopy frame on said base frame, and actuating means, adapted to be interconnected between said canopy frame and said base frame, for selectively moving said canopy frame to a selected position between its upright and fully lowered positions, each of said base side panels, said canopy side panel frames, said sub-frame, and said cross-struts being adapted to be connected to and completely disconnected from each other and being at least substantially flat and sized to be compactly packaged into at least one container to provide a knocked-down sheltering lounge in kit form having a volume that is not more than approximately one-fifth of the erected form of said sheltering lounge for shipping purposes.

2. The sheltering lounge of claim 1 wherein said at least one container includes at least two containers, each of said containers having a length and a girth dimension which, when added together, total less than 130 inches.

3. The sheltering lounge of claim 1 wherein said at least one container includes at least two containers, each of said containers having a length, a width and a height dimension, wherein each of said length, width and height dimensions is not greater than 48 inches.

4. The sheltering lounge of claim 1 wherein said pivot means includes means for pivotally mounting said canopy frame rearwardly on said base including a pair of laterally spaced bracket and pivot assemblies.

5. The sheltering lounge of claim 1 further comprising operator-controlled combined moving, holding and locking control system means, including said actuating means, mounted in said base frame and adapted to be connected to and disconnected from said canopy frame for selectively moving said canopy frame between its upright and fully lowered positions on said base frame.

6. The sheltering lounge of claim 1 further comprising a pair of inclined and laterally spaced rails secured in said base frame and a footrest frame having rollers thereon adapted to slide on said rails for storage within said base frame.

7. The sheltering lounge of claim 1 further comprising an upholstery main body adapted to cover a top, back and a first one of said canopy side panel frames, a separate upholstery side panel adapted to cover a second one of said canopy side panel frames, and fastening means for releasably attaching said separate upholstery side panel to side edges of the top and back panels of said upholstery main body.

8. The sheltering lounge of claim 7 further comprising a liner adapted for securance to the top and back of said canopy frame.

9. The sheltering lounge of claim 1 further comprising a plurality of spaced casters mounted beneath said sub-frame for permitting said sheltering lounge to be moved to various positions.

10. The sheltering lounge of claim 9 further comprising center pivot means mounted beneath said sub-frame and positioned at least approximately centrally thereof for selectively permitting said lounge to be rotated in a circular path about a vertically disposed axis whereby the frontal side of said canopy frame can be moved to a selected relative position for sunning and viewing purposes.

11. The sheltering lounge of claim 10 wherein said center pivot means comprises a center pivot caster of said casters.

12. The sheltering lounge of claim 11 wherein said center pivot caster comprises a mounting plate secured to an underside of said sub-frame, a swivel bracket pivotally mounted on said plate for relative pivotal movement about said axis and a roller rotatably mounted on said bracket.

13. The sheltering lounge of claim 12 further comprising brake lever means pivotally mounted on said bracket to selectively prevent rotation of said roller.

14. The sheltering lounge of claim 13 wherein said casters further comprise a pair of laterally spaced front casters and a Fair of laterally spaced rear casters and wherein each of said front and rear casters comprise a said mounting plate, swivel bracket, roller, and brake lever means.

15. The sheltering lounge of claim 10 further comprising operator-control means for selectively rotating said lounge about said axis.

16. The sheltering lounge of claim 15 wherein said operator-control means comprises a drive motor, having rotatable drive wheel means movably mounted on said sub-frame and means for selectively moving said drive wheel means from a raised position to a lowered position.

17. The sheltering lounge of claim 10 further comprising track means concentrically disposed relative to said axis for engaging and guiding at least some of said casters in a circular path in response to rotation of said lounge.

18. The sheltering lounge of claim 1 further comprising astrological observation means for enabling the lounge to be particularly positioned so that a user reclining within the canopy is able to view a desired portion of sky and constellations therein, said observation means including means for determining a directional position of the lounge, and means for determining an angular position of the canopy relative to a horizontal axis.

19. The sheltering lounge of claim 18 further comprising means in communication with said astrological observation means for providing the user with a description of the constellations within the portion of sky which is within the view of the user.

20. A chaise lounge usable for sun bathing and the like comprising:

a base frame having laterally spaced and vertically disposed sides and a horizontally disposed top adapted to retain a seating cushion thereon, a normally upright canopy frame having laterally spaced and vertically disposed sides, a top and a normally upright back all secured together to form a hood open on its frontal side thereof, pivot means for pivotally mounting a lower end of each side of said canopy frame on said base frame for permitting said canopy frame to be moved through an infinite number of positions between a normal upright position to form a seating arrangement and a fully lowered position placing the back of said canopy frame in at least general horizontal alignment with the top of said base frame to form a bed, combined lock and return means pivotally interconnected between said canopy frame and said base frame for selectively and releasably holding and locking said canopy frame in a selected lowered position between its upright and fully lowered positions and for automatically returning said canopy from its selected position to its upright position in response to releasing said locking of said canopy frame, astrological observation means for enabling the lounge to be particularly positioned so that a user reclining within the canopy is able to view a desired portion of sky and constellations therein, said observation means including means for determining a directional position of the lounge, and means for determining an angular position of the canopy relative to a horizontal axis; and means in communication with said astrological observation means for providing the user with a description of the constellations within the portion of sky which is within the view of the user.

* * * * *